United States Patent [19]

Sonobe et al.

[11] Patent Number: 4,725,242

[45] Date of Patent: Feb. 16, 1988

[54] ELECTRICAL CONNECTOR HAVING CAM ACTUATED WIRE HOLDING MEANS

[75] Inventors: Toshimitsu Sonobe, Tokyo; Masahiro Yamamoto, Kanagawa, both of Japan

[73] Assignee: Thomas & Betts Corporation, Raritan, N.J.

[21] Appl. No.: 908,845

[22] Filed: Sep. 18, 1986

[30] Foreign Application Priority Data

Sep. 25, 1985 [JP] Japan ..... 60-210348

[51] Int. Cl.[4] ..... H01R 13/52

[52] U.S. Cl. ..... 439/279; 439/589

[58] Field of Search ..... 339/59 R, 59 M, 63 R, 339/63 M, 61 R, 61 M, 94 R, 94 M

[56] References Cited

U.S. PATENT DOCUMENTS 4,090,759 5/1978 Herrmann, Jr. ..... 439/279
4,090,764 5/1978 Malsby et al. ..... 439/589
4,565,416 1/1986 Rudy et al. ..... 339/59 M
4,621,883 11/1986 Naguchi ..... 339/94 M
4,674,814 6/1987 Hoshino et al. ..... 439/586

*Primary Examiner*—Gil Weidenfeld
*Assistant Examiner*—Paula A. Austin
*Attorney, Agent, or Firm*—Robert M. Rodrick; Salvatore J. Abbruzzese

[57] ABSTRACT

An electrical connector comprises an insulative housing having a cavity therein for sealably receiving a rubber bush. At the bottom wall of the cavity the housing supports a movable plate having a plurality of holes therein for receipt of a respective plurality of contacts of terminated electrical wires. The bush includes a like plurality of holes aligned with the holes in the plate. The plate comprises a projecting cam that is engaged upon insertion of a cam actuator, the plate being moved in response to such insertion to lock the contacts in the housing by the edges of the plate defining the holes therein.

4 Claims, 2 Drawing Figures

ELECTRICAL CONNECTOR HAVING CAM ACTUATED WIRE HOLDING MEANS

FIELD OF THE INVENTION

The present invention relates to an electrical connector and more particularly to the type of connectors having waterproof capability.

BACKGROUND OF THE INVENTION

In conventional connectors of the waterproof type, each of wires terminated by contacts is inserted through a rubber bush, using a special tool, in advance, and the resultant assembly in a sealed state is received within a cavity of a housing. Therefore, it takes considerable period of time to assemble the wires in a connector, and more convenient assembly means are desirable.

In addition, a round pin (having no orientation) has been conventionally used. Thus, the wire cannot be readily connected to, for example, a tab-like contact provided on a printed circuit board.

SUMMARY OF THE INVENTION

The present invention has been made in order to eliminate the defects in conventional connectors, and has as its objects to allow wires to respectively pass through rubber bushes without using a tool, thereby achieving a more economical and efficient operation during assembly of the wires in a connector.

In accordance with a preferred form of the invention, an electrical connector for assembling wires each terminated by a contact comprises a housing defining a cavity and a wire holding section. There are a plurality of holes provided through the wire holding section, each hole arranged to allow a wire to pass therethrough, each of the holes being disposed adjacent the housing cavity. Biasing means is provided to bias the holding section in a direction crossing the direction of wire insertion such that upon actuating the biasing means the wires may be engaged by the holding section and held in the housing.

A connector assembly according to the present invention will be described below in detail, with reference to embodiments thereof illustrated in the accompanying drawings.

DETAILED DESCRIPTION OF THE PREFERRED EMBODIMENT

Figure 1:
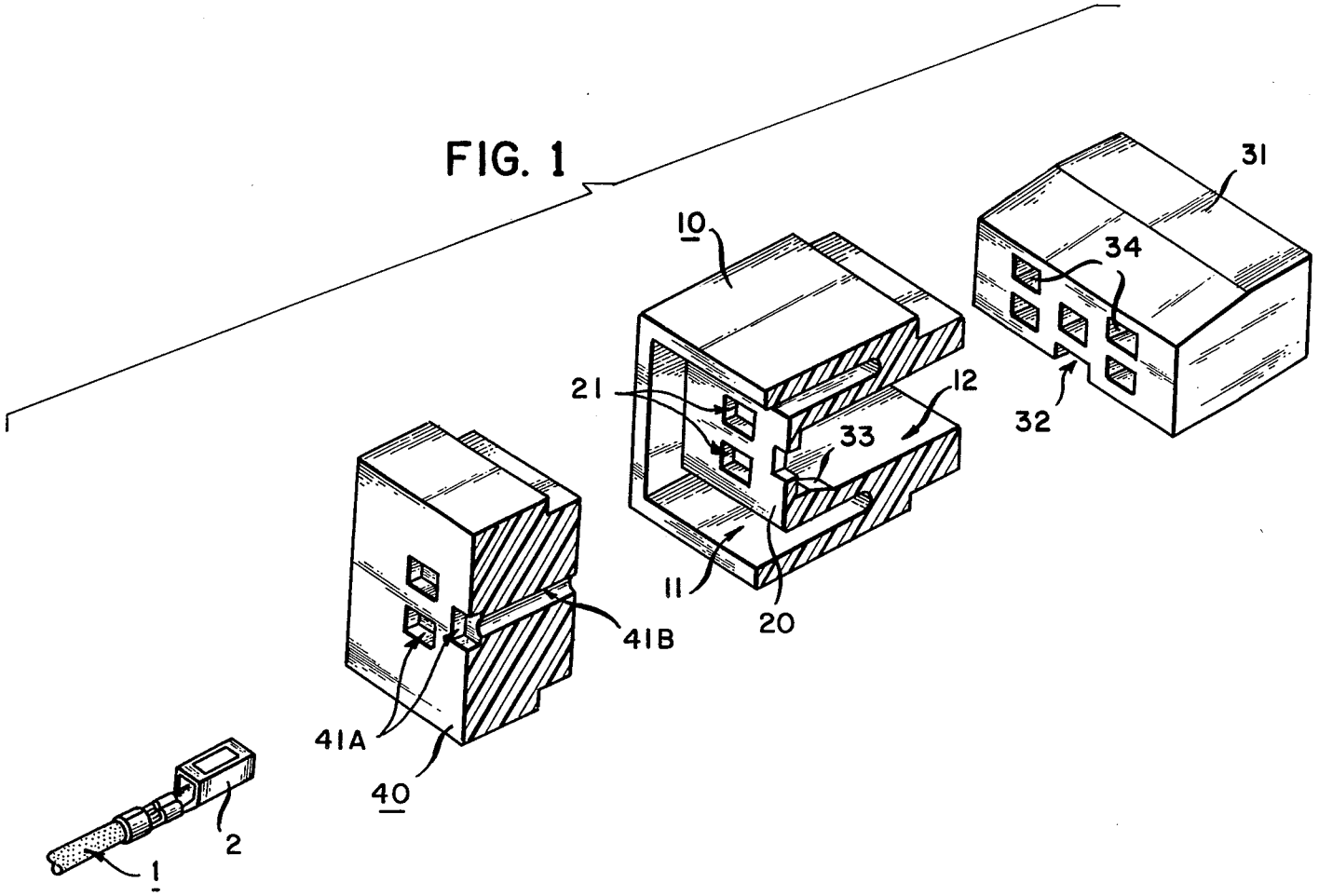
FIG. 1 is an exploded view illustrating a connector assembly according to a preferred embodiment of the present invention.
Figure 2:
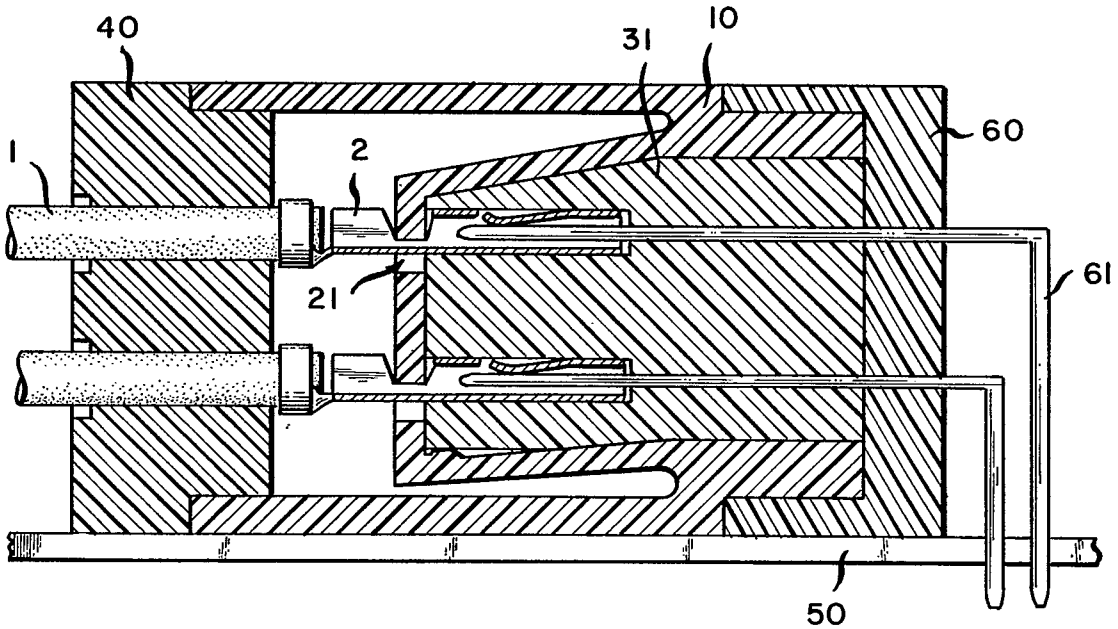
FIG. 2 is a longitudinal sectional view of the embodiment shown in FIG. 1.

Referring now to FIGS. 1 and 2, there is shown a connector of the female type and is connected to a tab 61 of a male type connector 40 provided on a printed circuit board 50 in practical use, as shown in FIG. 2. Since the type of connector (i.e., male or female) is determined by the shape of the contact thereof and is not essential, the present invention can be applied to connector assemblies of either type.

In FIG. 1, reference numeral 1 denotes a wire which is terminated by a contact 2. Typically, a cylindrical contact having a terminal portion of rectangular cross-section is used, but the present invention is not limited to this configuration, as previously described.

Reference numeral 10 denotes an insulative housing which has a cavity 11 for receiving a rubber bush 40 to be described hereinafter and a cavity 12 for receiving an actuator member 31 to be described later. The cavity 12 is formed such that it projects from the bottom portion of the cavity 11, opposite the opening of the cavity 11, toward the inside of the cavity 11.

A wire holding section 20 having hole portions 21 each for allowing the wire to pass therethrough is provided in the bottom portion of the cavity 11. The holding section can be vertically moved (in the embodiment shown in the drawing) by the actuator member 31 (to be described below in detail). It should be noted that the shape of the hole portion 21 of the wire holding section is not limited to that of the embodiment shown in the drawing.

Reference numeral 31 denotes the actuator member. The actuator member 31 has hole portions 36 each for receiving a contact which has passed through the rubber bush and the wire holding section, and an engaging groove 32 corresponding to a projection 33 provided in the bottom portion of the cavity 12 of the housing 10.

When the actuator member is inserted in the cavity 12, each contact is inserted in a corresponding hole portion 34 in the actuator member, the projection 33 is engaged with the groove 32 to vertically move the wire holding section 20 (the bottom walls of the cavities 11 and 12), and the hole portions 21 of the wire holding section are engaged and held by the constricted portion of the contact 2, as shown in FIG. 2.

Reference numeral 40 denotes a rubber bush having hole portions through which the wires pass. Each hole portion comprises a recess 41A provided in one surface of the rubber bush, and a through hole 41B which extends from the bottom of the recess to the other surface of the rubber bush. The recess is provided with an opening of the shape corresponding to that of the cross-section of the above-mentioned contact.

The contact which terminates the wire is first inserted into the recess of the rubber bush, and is then passed through and expands the through hole. At this point, the orientation of the contact is determined since the shape of the recess opening corresponds to that of the cross-section of the contact. In addition, the respective wires are sealed by the through holes of the hole portions.

The rubber bush is sealably fixed within the cavity 11 of the housing by securing means which is shown as a projection on the outer side wall of the rubber bush and an engaging groove formed in the housing for engaging therewith.

The construction of the connector assembly according to the present invention has been described above and provides the following unique effects.

Namely, in the connector according to the present invention, the terminal end of the wire can be inserted through the rubber bush without using a special tool. In addition, the fixed direction of insertion can be maintained by matching the shape of the noncircular terminal end with that of the recess bush, and the wire passed through the rubber bush is sufficiently sealed by the through hole, which communicates with the above-mentioned recess, thereby rendering the connector waterproof.

With the holding plate according to the present invention, the terminal ends of the wires are respectively inserted through the hole portions of the holding plate and thereafter the plate is slid, whereby the terminal ends can be integrally engaged with and held in the plate. This results in significant improvement in the efficiency of the assembly operation.

The present invention can be widely applied. For example, since the contact of the present invention is formed as a cylindrical contact having a rectangular cross-section, it can be connected with a flat tab terminal 61 (contact) extending through a header 60 provided on a printed circuit board 50.

Having described the preferred embodiment of the invention, it can be appreciated that variations may be made thereto without deviating from the contemplated scope of the invention. Accordingly, the preferred embodiment described herein is intended in an illustrative rather than limiting sense, the true scope of the invention being set forth in the claims appended hereto.

I claim:

1. An electrical connector assembly comprising:

wires (1) each terminated by a contact (2);

a rubber bush (40) having hole portions for allowing said wires to pass therethrough;

a housing (10) defining a cavity for receiving said rubber bush;

a wire holding section 20 having hole portions (21), each for allowing each of said wires to pass therethrough, formed in the bottom portion of said cavity; and biasing means for biasing said holding section in a direction crossing with the insertion direction of said wire;

said housing defining another cavity (12) which projects from the bottom portion of said cavity on the opposite side thereof toward the inside of said cavity;

said biasing means comprising an actuator member (31) housed in said another cavity 12, a cam groove (32) formed in said actuator member, and a cam projection (33) provided in the bottom portion of said another cavity, for engaging with said cam groove, said actuator member having hole portions (34) each for holding said contact of each of said wires which have passed through holes of said engaging section.

2. A connector assembly according to claim 1, characterized in that:

said contact has a generally rectangular cross-section, and said hole portion of said rubber bush comprises a recess (41A) formed on one surface of said rubber bush and having a rectangular opening corresponding to the sectional shape of said contact, and a through hole (41B) extending from the bottom surface of said recess to the other surface of said rubber bush.

3. A connector according to claim 1, further comprising means for securing said rubber bush within said housing.

4. A connector assembly according to claim 1, characterized in that said contact is a cylindrical receptacle contact having a rectangular terminal section.

* * * * *